US006088995A

United States Patent [19]

Robinson et al.

[11] Patent Number: 6,088,995

[45] Date of Patent: Jul. 18, 2000

[54] SYSTEM FOR AUTOMATIC INSPECTION AND EJECTION OF CARTONS IN A PACKAGING MACHINE

[75] Inventors: Glenn Robinson, Alpharetta; Thomas M. Potteiger, Powder Springs; Jeffrey G. Jacob, Gainesville, all of Ga.

[73] Assignee: The Mead Corporation, Dayton, Ohio

[21] Appl. No.: 09/098,783

[22] Filed: Jun. 17, 1998

[51] Int. Cl.[7] ..... B65B 21/02; B65B 57/04

[52] U.S. Cl. ..... 53/53; 53/48.1; 53/55; 53/69

[58] Field of Search ..... 53/53, 55, 505, 53/506, 69, 67, 48.8, 48.9, 48.7, 48.6, 48.1

[56] References Cited

U.S. PATENT DOCUMENTS

| | | | |
|---|---|---|---|
| 4,064,675 | 12/1977 | Stapp et al. | 53/53 X |
| 4,814,072 | 3/1989 | Von Wichert et al. | 53/53 X |
| 4,955,176 | 9/1990 | Seko et al. | 53/55 X |
| 4,984,409 | 1/1991 | Focke | 53/53 |
| 4,998,910 | 3/1991 | Mohaupt et al. | 53/53 X |
| 5,671,587 | 9/1997 | Robinson | 53/398 |

*Primary Examiner*—James F. Coan
*Attorney, Agent, or Firm*—Michael V. Drew

[57] ABSTRACT

A system for automatic inspection and ejection of cartons in a packaging machine includes detection elements (20, 22) for determining whether a carton (C) has assumed a predetermined configuration at a predetermined point in its path of travel. Carton ejection elements include rollers (30, 32) which are actuated to eject a carton (C) when the detection elements (20) determine that the carton has not assumed the predetermined configuration at the predetermined point in its path of travel. A synchronous relationship between a flow of cartons (C) and a flow of groups of articles (G) to be packaged is preserved at and as cartons leave the carton inspection and ejection station of a packaging machine.

4 Claims, 8 Drawing Sheets

SYSTEM FOR AUTOMATIC INSPECTION AND EJECTION OF CARTONS IN A PACKAGING MACHINE

FIELD OF THE INVENTION

The present invention relates generally to machines for packaging articles in cartons, and more particularly to a packaging machine system in which cartons are automatically inspected to determine their condition for loading and in which inspected cartons of a predetermined undesirable condition are automatically ejected while the synchronous relationship between carton flow and article flow is preserved.

BACKGROUND OF THE INVENTION

In continuous-motion packaging machines a carton which is not in the proper set-up condition for receiving articles to be packaged can hinder efficient operation of the machine. It would be useful to automatically determine when cartons would not be in proper condition to receive articles. It would also be useful to have a means for automatically ejecting a carton which is determined not to be in proper condition while preserving a synchronous relationship between a flow of cartons and a flow of articles to be packaged.

SUMMARY OF THE INVENTION

A preferred embodiment of the present invention provides a system which includes detection elements for automatically determining whether a carton has assumed a predetermined configuration at a predetermined point in its path of travel. The system further includes carton ejection elements which are actuated to eject a carton when the detection elements determine that the carton has not assumed the predetermined configuration at the predetermined point in its path of travel. In conjunction with carton inspection and ejection the system preserves a synchronous relationship between a flow of cartons and a flow of articles to be packaged.

Other advantages and objects of the present invention will be apparent from the following description, the accompanying drawings, and the appended claims.

DETAILED DESCRIPTION OF THE PREFERRED EMBODIMENT

Figure 1:
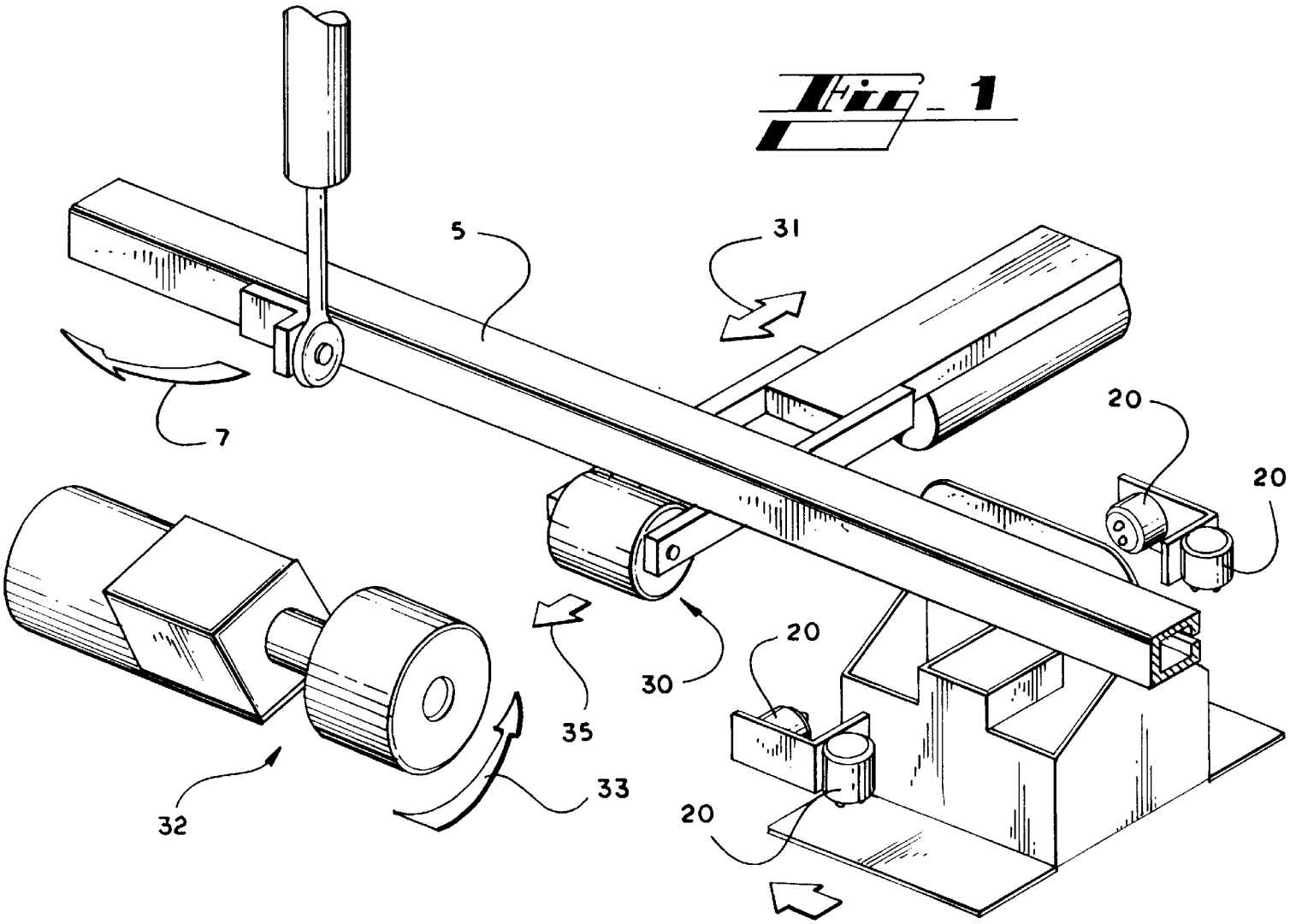
FIG. 1 is a perspective view of a preferred embodiment of a system for automatically inspecting and ejecting cartons in a packaging machine.

Throughout the drawings the same reference numerals are used to denote the same features of the preferred embodiment of the invention. In the preferred embodiment described herein a means is provided for detecting whether cartons which are transported in a packaging machine have assumed a desired predetermined configuration at a designated point in the machine. As an example, the invention is particularly suited for use in a packaging machine for loading basket-style carriers such as that described in U.S. Pat. No. 5,671,587, which patent is also owned by the owner of the present invention and patent application. U.S. Pat. No. 5,671,587 is hereby incorporated by reference. In general, a desired configuration for a basket-style carton is the erected, squared-up condition for receiving bottles or other articles in which side and end wall panels of the carton are substantially orthogonally disposed with respect to one another.

Figure 2:
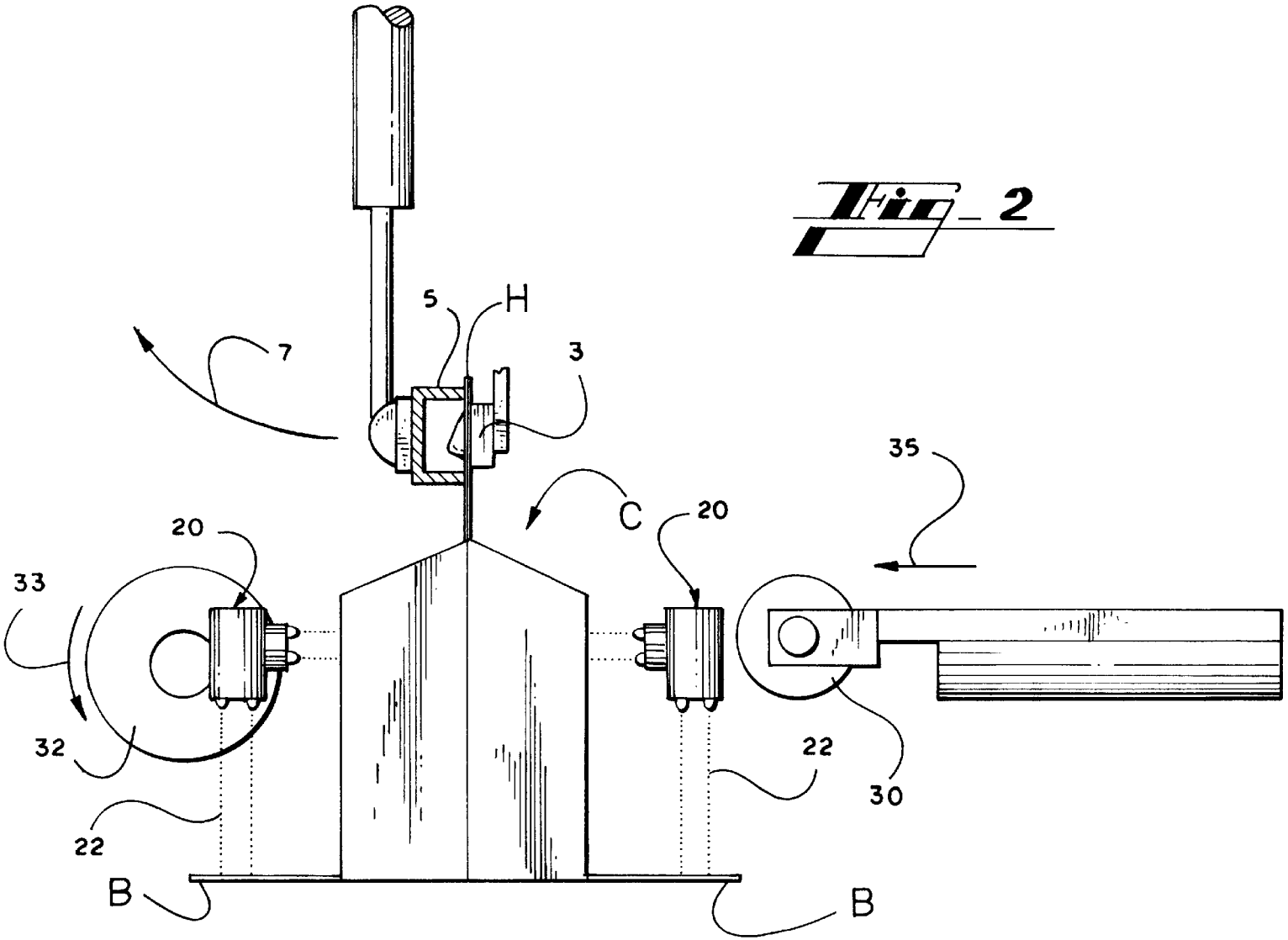
FIG. 2 is an elevational view of the system of FIG. 1 showing a cross-section of the guiderail and the alignment of the system elements in relation to pertinent parts of a packaging machine.
Figure 3:
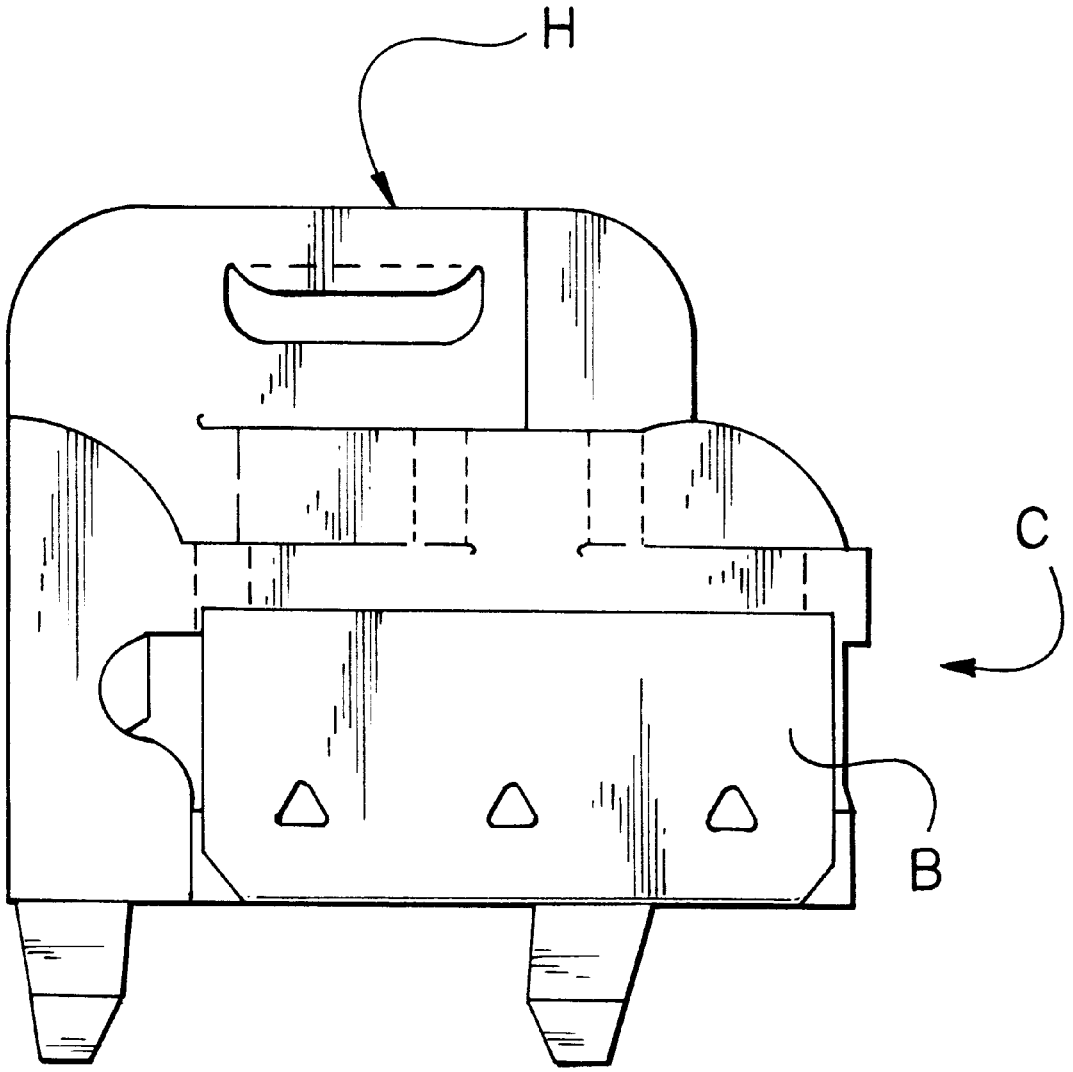
FIG. 3 is a more detailed illustration of the basket-style carton shown in the preferred embodiment of FIGS. 1 and 2, the carton shown in collapsed condition.
Figure 4:
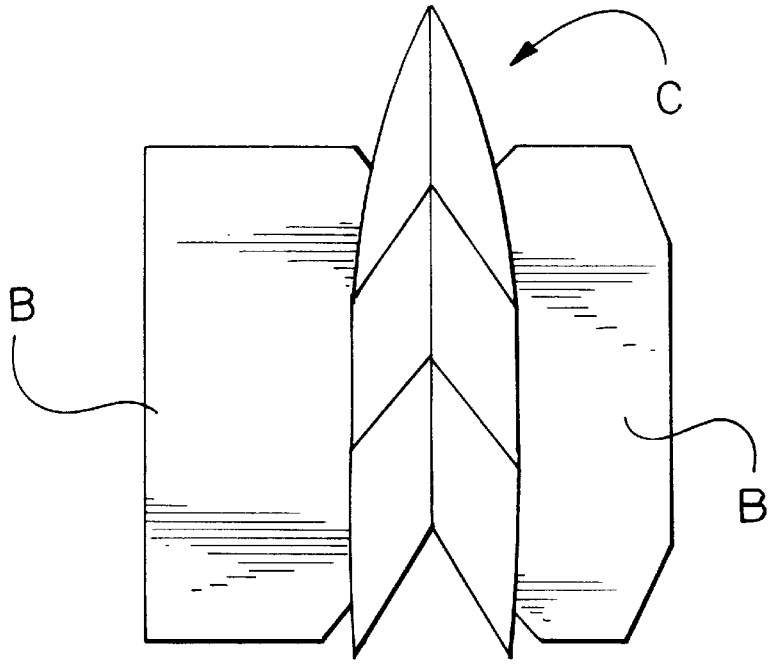
FIG. 4 is a top view schematic representation of the carton of FIG. 3 shown in partially erected, squared-up condition.
Figure 5:
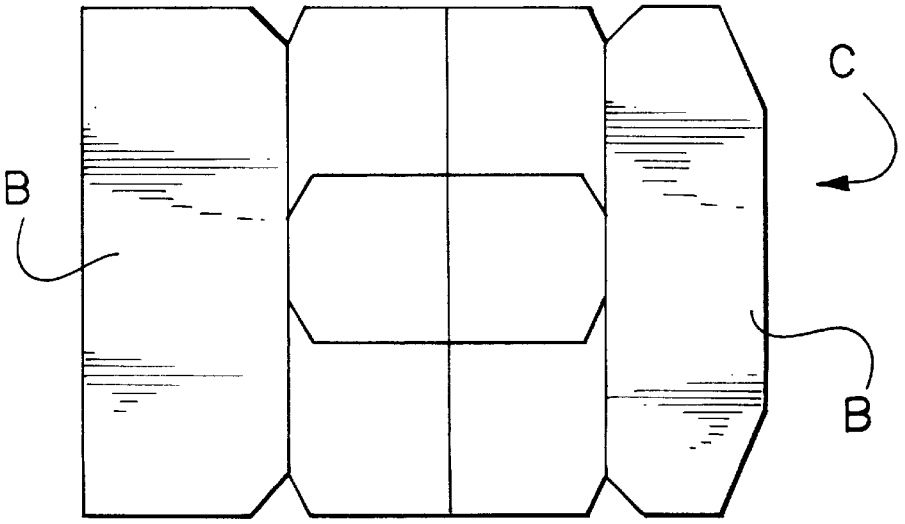
FIG. 5 is a continuation of the schematic representation of FIG. 4 depicting the carton in fully-erected, set-up condition suitable for loading.

Referring momentarily to FIGS. 3 through 5, therein are illustrated a typical sequence of carton-erection steps which help illustrate the invention. FIG. 3 shows the carton C in collapsed condition. FIG. 4 shows the carton in partially erect and set-up condition. FIG. 5 shows the carton C in optimum fully-erect, squared set-up condition. The invention provides a means for determining whether at a selected point in carton transport the carton C has achieved the condition shown in FIGS. 1, 2 and 5, or whether the carton has remained in an undesirable condition such as the collapsed condition of FIG. 3, or the semi-collapsed condition of FIG. 4, or some other undesirable configuration. The invention further provides a means for determining whether the bottom closure panels B of the basket-style carton illustrated lie substantially horizontal as required at a certain point in the carton path.

Referring to FIGS. 1 and 2 simultaneously, a system 10 for the automatic inspection and ejection of cartons in a packaging machine in accordance with a preferred embodiment of the invention is illustrated. The invention is shown and described in the context of a packaging machine for basket-style carriers. A typical basket-style carton C is also illustrated. In the context illustrated, the carton C is transported through a machine environment in which the handles H of cartons are impaled through typical carton handholes upon a series of circulating insert members 3 (more clearly seen in FIG. 2). In the packaging machine context illustrated a guiderail 5 serves as a backstop for the carton transporting insert members 3 and cartons C. This machine environment is described in greater detail in U.S. Pat. No. 5,671,587.

The system 10 includes a detector mechanism which includes various sensor elements 20 that are arranged along the transport path of the cartons C. The sensors 20 are arranged at a point along the carton transport path before which point the cartons should have been placed in a predetermined configuration, for example, an erected, squared-up configuration suitable for loading (see FIGS. 1, 2, and 4). In the carton C illustrated in the preferred embodiment the carton has assumed a predetermined configuration at a predetermined point in its path of travel. In the desired configuration which is used to describe the invention, not only is the carton erected and squared up but the bottom closure flaps, or panels, B extend outwardly from the side walls of the carton C and lie substantially horizontal. Referring now particularly to FIGS. 1 and 2, the sensors 20 are arranged to detect a predetermined alignment of various carton panels. A typical sensor 20 is a proximity mode type sensor in which an emitter and a receiver act in conjunction with one another. In this typical sensor 20 of the preferred embodiment at least one beam 22 of electromagnetic energy is projected from the sensor and the receiver element is arranged and calibrated to expect a reflected return signal. The sensors are arranged such that a carton C in a predetermined desired configuration causes the beams 22 to be properly reflected and received by the sensor receiver. Failure of the sensor's receiver to receive a properly reflected signal is indicative of improper carton formation. For example, in FIG. 2 light beams 22 are directed vertically downward such that the beams 22 are to be encountered and reflected by the bottom closure flaps B of the carton C if these flaps are properly horizontally extended from the carton C. If the bottom closure flaps are in a condition similar to that shown in the collapsed carton of FIG. 3, a beam 22 would not be reflected and known logic circuitry calculates that the carton C is not properly formed. If a carton is missing from the series of cartons in the carton transport such that a carton is not present at the detection station where the sensors 20 are located, the proper reflected signal will not be received by the sensors 20. Thus, the invention also detects the absence of a carton as an improperly-formed carton.

Detection of an improperly-formed carton causes the ejection mechanism to be actuated. The ejection mechanism includes a pair of rollers 30, 32 which for convenience of reference are referred to as a first roller 30 and a second roller 32. In the preferred embodiment both rollers 30, 32 normally reside in a position remote from the carton pathway so as to not interfere with carton travel. Although many variations are possible, in the preferred embodiment the first roller 30 is non-powered, is free-rolling and is transversely translatable (as illustrated by the double-ended arrow 31). The first roller 30 is transversely translatable in relation to the direction of carton motion between a position remote from the carton pathway and a position of engagement with a selected carton C traveling in the carton transport pathway. The second roller 32 is powered by known means to rotate in the counterclockwise direction indicated by the rotation arrow 33. As will be explained in greater detail, rotation in the counterclockwise direction shown ultimately causes a selected carton to be ejected upwardly and outwardly of the machine. The powered roller 32 may be in continuous rotation or may be actuated when a defective carton is detected.

Figure 6A:
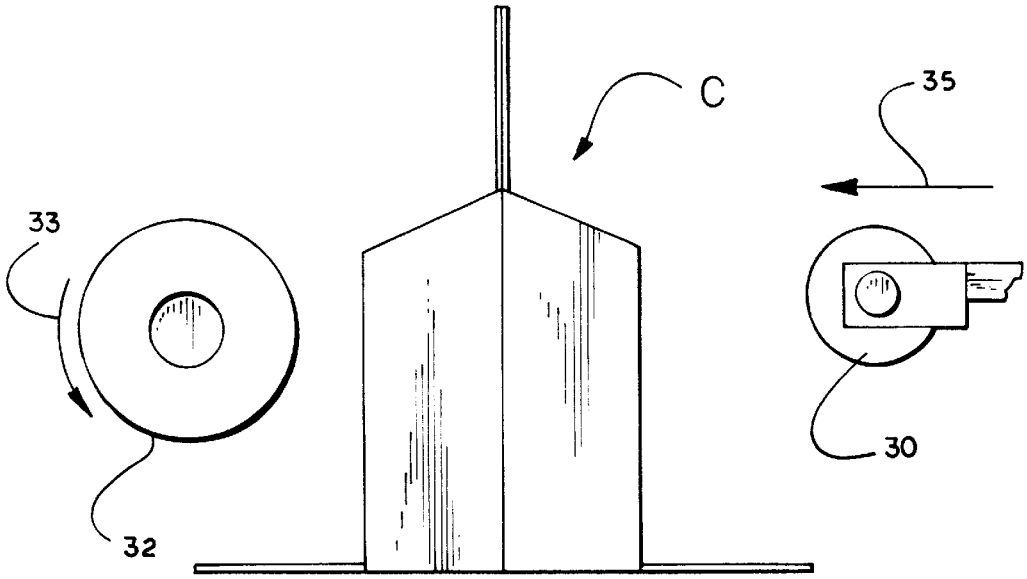
FIGS. 6A–6G are schematic illustrations of the sequence of steps executed by the rollers of the carton ejection mechanism of FIG. 1.
Figure 6B:
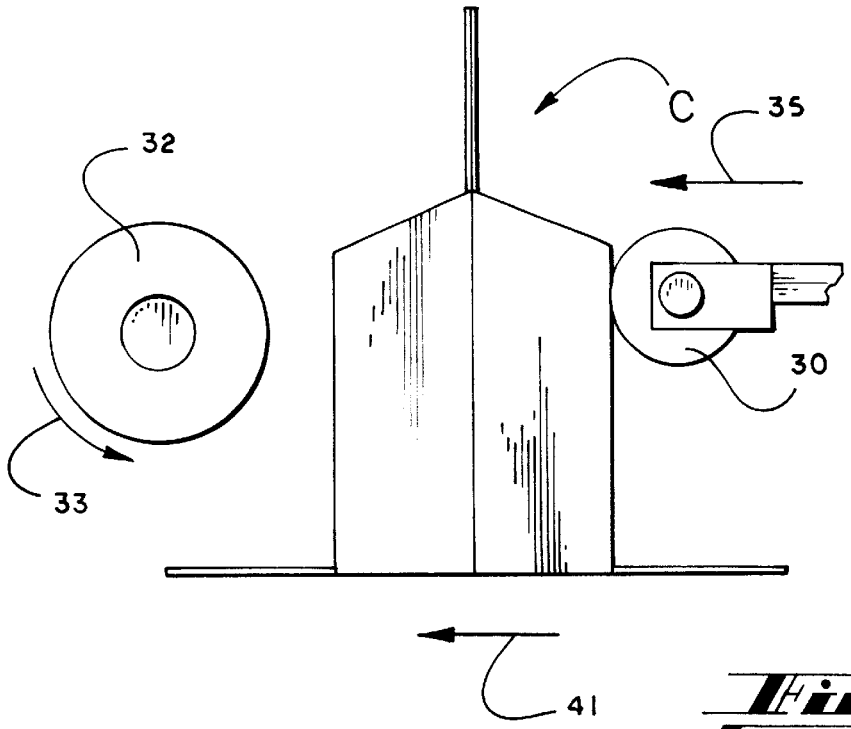
Figure 6C:
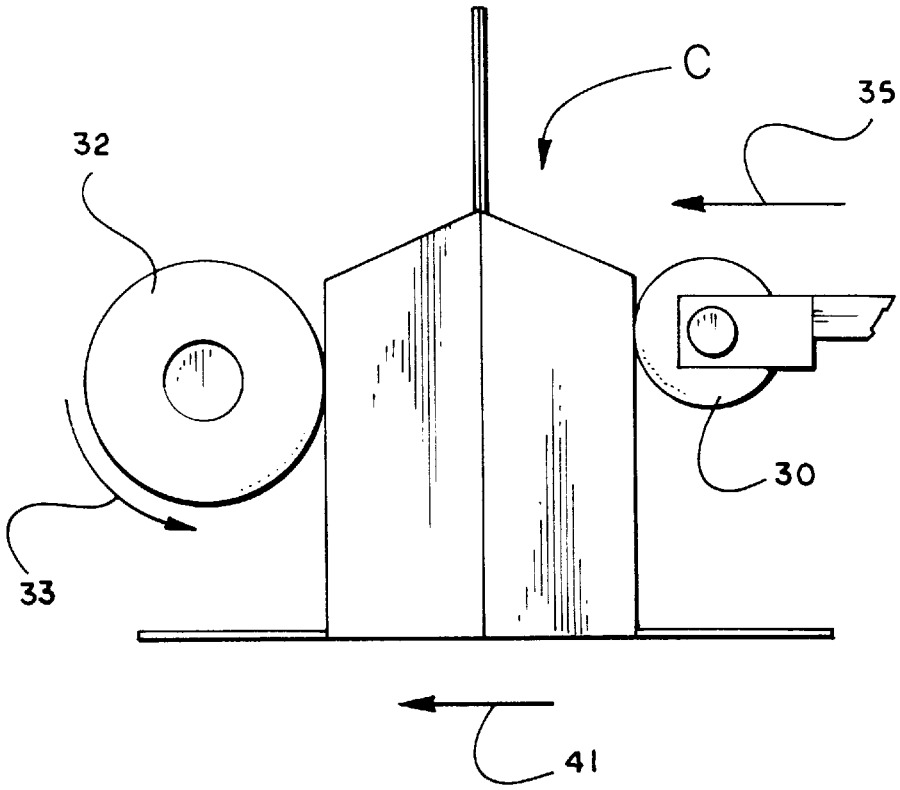
Figure 6D:
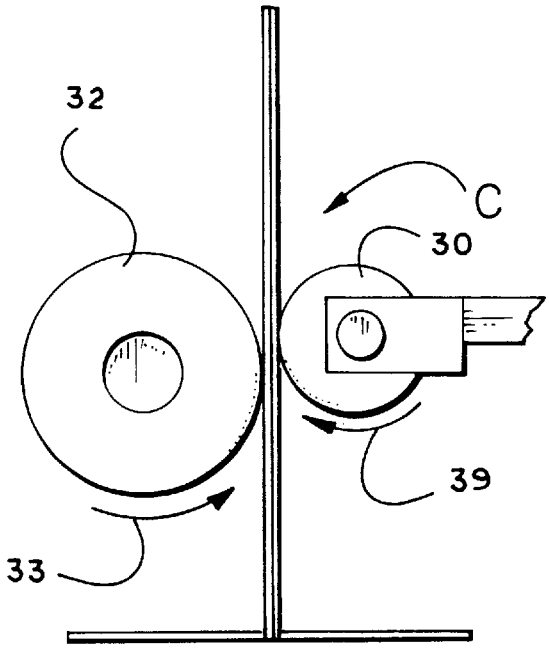
Figure 6E:
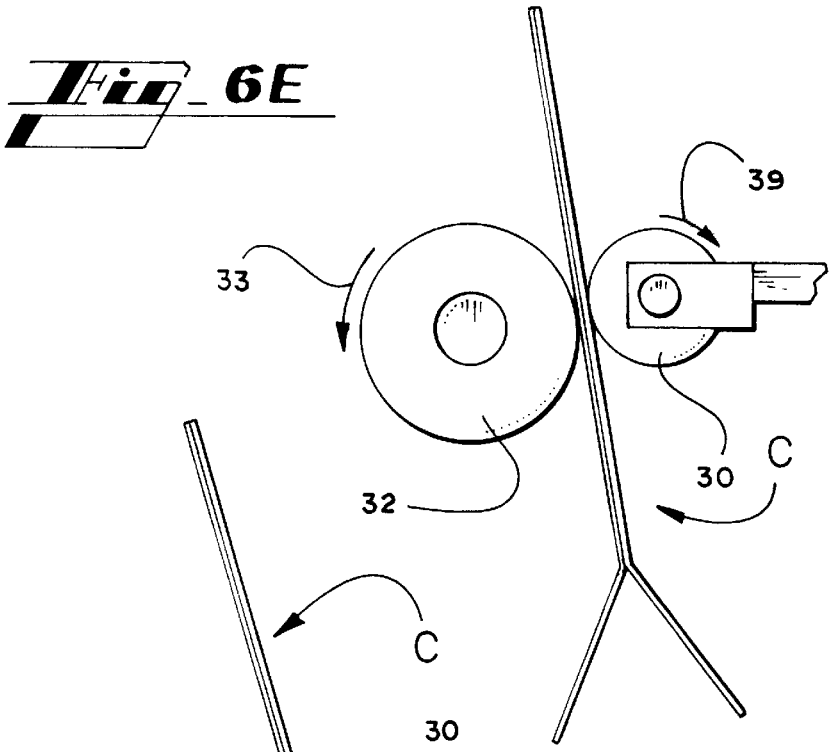
Figure 6F:
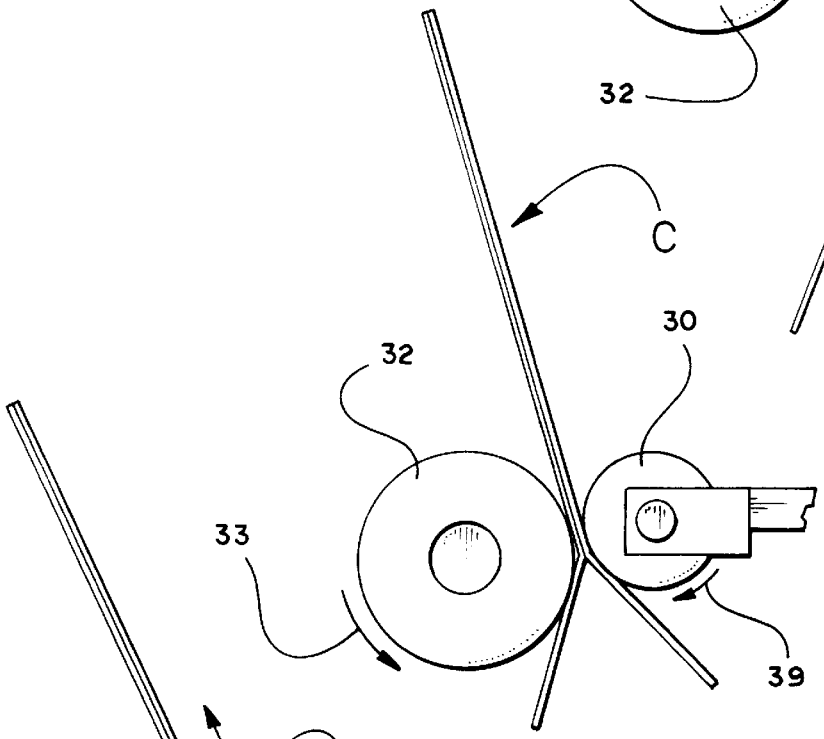
Figure 6G:
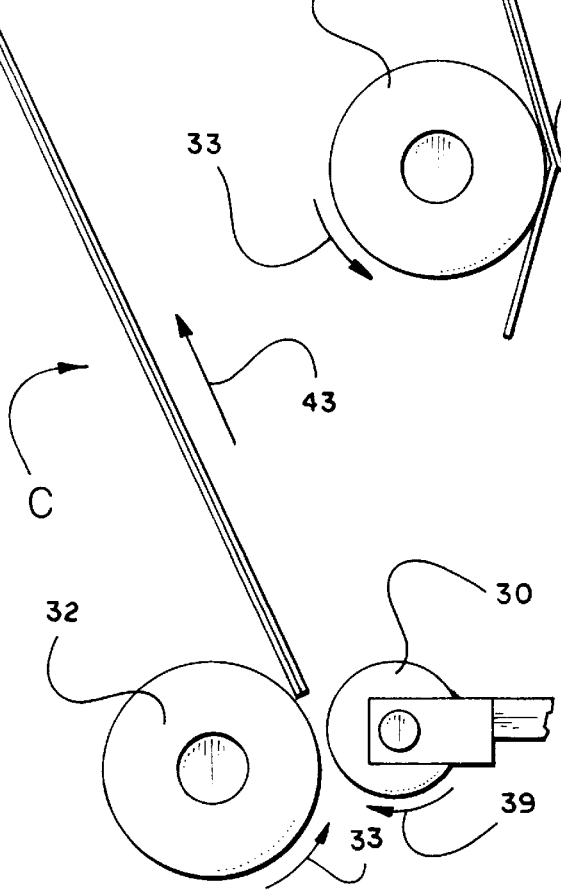

When the ejection mechanism is actuated the first roller 30 translates inwardly (see direction arrow 35) to engage the defective carton. Reference is now made to the schematic representation of FIGS. 6A through 6G. The first roller 30 moves inwardly 35 to engage the defective carton C and further causes the carton C to translate (as indicated by direction arrow 41) toward the powered roller 32. The carton is eventually pressed, or nipped, between the rollers 30, 32. The pressure exerted by the rollers 30, 32 causes the carton C to collapse (as shown in FIG. 6D). The "nip" pressure also causes the first roller 30 to rotate in harmony with the second roller 32 (the powered roller). The carton C is subsequently squeezed and spun out from between the rollers 30, 32 in the general direction denoted by the direction arrow 43. The first roller 30 is positioned vertically higher than the second roller 32 so that the upward-outward carton trajectory illustrated in FIGS. 6E through 6G can be achieved. Optimally, the final position of the pair of rollers 30, 32 is offset from the pathway of carton transport to better facilitate removal of the carton from the transport pathway. When the rollers 30, 32 are offset an ejected carton is less likely to encounter a machine part during the carton's ejection flight.

The invention anticipates that the carton C may be transported in a captive fashion such as by the insert 3 and guiderail 5 illustrated. When an improperly-formed carton is detected motion of the carton transport mechanism is interrupted such that the improperly-formed carton C is halted between the rollers 30, 32 of the ejection mechanism and the carton is either initially disengaged from its transport or prepared for disengagement therefrom. In the preferred embodiment, in preparation for disengagement of the selected carton C the guiderail 7 is swung upwardly and outwardly of the insert member 3 (in the general direct of the direction arrow 13) so that the carton may be disengaged therefrom. Thereafter, the elements of the ejection mechanism which are described above disengage the carton C from the insert member.

Figure 7:
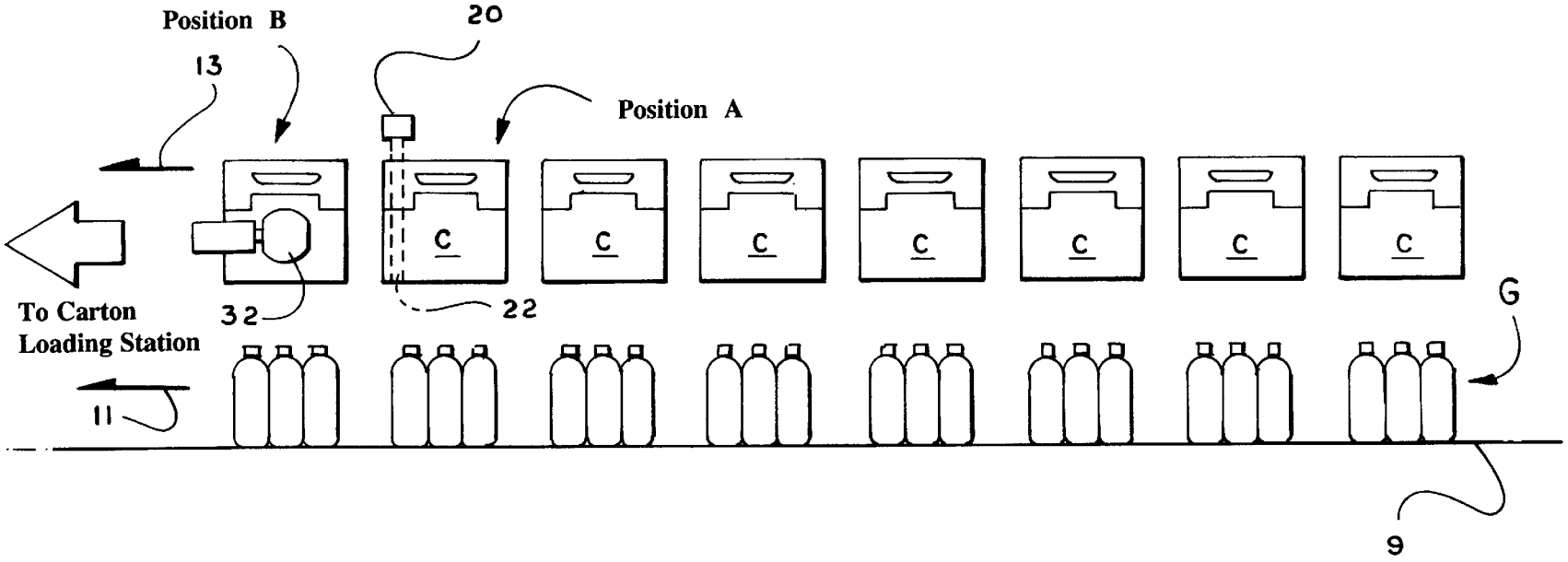
FIG. 7 is a schematic representation from an elevational viewpoint of a further aspect of the invention of FIG. 1.

Referring now to FIG. 7, a further aspect of the invention will be discussed wherein in addition to the features discussed above a preferred embodiment of the invention also helps maintain a synchronized relationship between a flow of cartons and a flow of articles to be packaged. The invention is particularly suitable for operating in the environment of a packaging machine such as that described in the aforementioned U.S. Pat. No. 5,671,587. According to this further aspect of the preferred embodiment of the invention an article transport mechanism such as a conveyor 9 (which moves articles in the direction generally indicated by direction arrow 11) operates in conjunction with the carton transport mechanism (which moves cartons in the direction generally indicated by direction arrow 13) whose operation has been described above. As the carton transport mechanism moves cartons C along a designated pathway the article transport mechanism 9 also moves groups of articles G (such as bottles) along another designated pathway such that the series of cartons C and series of article groups G travel in synchronous motion. By this mode of operation a one-to-one correspondence between groups of articles G to be packaged and cartons C is established. This one-to-one relationship facilitates carton loading which follows downstream in the packaging operation. The invention contemplates and the figures illustrate a group of articles containing at least one article to be packaged and is also applicable to a group containing only a single article.

It is important to maintain the one-to-one carton-article group relationship for optimum loading downstream. Once a carton has been ejected from the carton transport as described above, the one-to-one carton-article group relationship is disturbed. The invention restores this relationship through the use of a control mechanism which includes logic components such as a computer microprocessor. The control mechanism causes the carton transport to advance once a carton has been ejected to re-establish the one-to-one carton-article group relationship. As an example of the manner in which the invention re-establishes carton-article synchronization FIG. 7 illustrates a carton position A and a carton position B. Carton position B is located at the end of the carton transport section. In the preferred embodiment of the invention illustrated the rollers 30, 32 (only one roller 32 being visible in elevation) of the ejection mechanism are disposed at the end of the carton transport mechanism at position B. In the preferred embodiment illustrated the carton which is ejected at position B is first detected at carton position A, slightly upstream from position B. The control mechanism closes the "hole" left in the carton series by the ejected carton by causing the carton transport to advance ahead of the article transport until the one-to-one carton-article group relationship is re-established. The "advance" to accomplish re-synchronization is achieved by causing the carton transport to "speed" ahead of the article transport to make up for the space, or hole in the series of transported cartons. Carton transport advance is also easily achieved by idling, or otherwise suspending motion of, the article transport 9 while the carton transport is advanced. In the preferred embodiment illustrated in FIG. 7, the carton C which occupies the carton position A at the time of ejection of the carton at position B is automatically advanced to the carton transport position B. Once the carton-article group relationship has been re-established the carton transport and article transport are automatically returned to synchronous motion. Numerous variations in the speed of the carton transport and article transport and variations in the control of the synchronous relationship between the carton transport and article transport are easily accomplished through the use of servo motors in the preferred embodiment of the invention.

While the invention has been described with particular reference to packaging basket-style article carriers the invention is equally applicable to the packaging of other types of cartons that have panels and flaps that must assume a predetermined alignment by the time that the carton reaches a certain location during its transport. As is evident from the foregoing description, certain aspects of the invention are not limited to the particular details of the examples illustrated, and it is therefore contemplated that other modifications and applications will occur to those skilled in the art. For example, the light beams 22 used in the sensors 20 may be visible or non-visible light (such as infrared radiation). Even further, other types of electromagnetic radiation which can be projected to and received at a location point in a manner that allows surfaces to be detected may also be used. The sensor 20 may also consist of a sound wave generator (such as a speaker) and a sound wave detector/receiver (such as a microphone) wherein a sound wave detectable in the machine environment (such as an ultrasonic frequency sound wave) is transmitted in the same manner as electromagnetic radiation to encounter a carton flap or panel and thereby verify its positioning. As a further example of anticipated variations the non-powered and powered rollers 30, 32 may be reversed, or both rollers 30, 32 may be powered.

Accordingly, it is intended that the claims shall cover all such modifications and applications as do not depart from the true spirit and scope of the invention.

What is claimed is:

1. A system for inspecting cartons to be loaded with groups of articles each group containing at least one article, the system comprising:

carton transport mechanism for translating a plurality of cartons in series along a designated pathway;

article transport mechanism for translating the groups of articles in series in timed relationship with the plurality of cartons such that a one-to-one correspondence between the cartons and the groups of articles is maintained;

sensor mechanism for detecting whether a carton has assumed a predetermined configuration at a first carton-transport position as the carton is translated along the designated pathway by the carton transport mechanism;

ejection mechanism in electromechanical communication with said sensor mechanism which ejection mechanism selectively operatively engages a carton at a second carton-transport position which carton has been detected as not having assumed said predetermined configuration, dislodges the carton from the carton transport and removes the carton from the designated pathway; and a control mechanism for causing a flow of the cartons in the carton transport mechanism to advance in relation to a flow of the groups of articles in the article transport when a carton has been ejected such that the one-to-one correspondence between the cartons and the groups of articles is maintained.

2. The system of claim 1, wherein when a carton has been ejected the control processor causes the article transport mechanism to idle and the carton transport mechanism to advance until the one-to-one correspondence between the cartons and the groups of articles has been re-established.

3. A system for inspecting cartons, the system comprising:

sensor mechanism for detecting whether a carton has assumed a predetermined configuration as the carton is translated along a designated pathway by a carton transport, the carton transport including an insert member for engaging a carton hand hole and a selectively operable carton restraining member which prevents dislodgment of the carton from the carton transport including an elongated U-shaped guide rail proximately disposed for longitudinal translation of an anterior portion of said insert member within said U-shaped channel which carton restraining member upon detection by said sensor mechanism that a carton has not assumed said predetermined configuration is disengaged by moving said guide rail to a position remote from said insert member such that a selected carton may be dislodged; and ejection mechanism in electromechanical communication with said sensor mechanism which ejection mechanism selectively operatively engages a carton which has been detected as not having assumed said predetermined configuration, dislodges the carton from the carton transport and removes the carton from said designated pathway.

4. A system for inspecting cartons, the system comprising:

sensor mechanism including at least one sensor element arranged in a predetermined matrix configuration projecting a beam of electromagnetic energy for detecting the presence of an obstruction in the path of the beam as the carton is translated along a designated pathway by a carton transport, the carton transport including an insert member for engaging a carton hand hole and a selectively operable carton restraining member which prevents dislodgment of the carton from the carton transport including an elongated U-shaped guide rail proximately disposed for longitudinal translation of an anterior portion of said insert member within said U-shaped channel which carton restraining member upon detection by said sensor mechanism that a carton has not assumed said predetermined configuration is disengaged by moving said guide rail to a position remote from said insert member such that a selected carton may be dislodged; and ejection mechanism in electromechanical communication with said sensor mechanism such that when a predetermined presence or absence of said obstruction has been detected said ejection mechanism is actuated to selectively operatively engage a carton, dislodge the carton from the carton transport and remove the carton from said designated pathway.

* * * * *